US006481056B1

(12) United States Patent
Jesse

(10) Patent No.: US 6,481,056 B1
(45) Date of Patent: Nov. 19, 2002

(54) INTERGRATED DOOR CHECK HINGE FOR AUTOMOBILES

(75) Inventor: Gerhard Jesse, Wedermark (DE)

(73) Assignee: Multimatic Inc., Markham (CA)

( * ) Notice: Subject to any disclaimer, the term of this patent is extended or adjusted under 35 U.S.C. 154(b) by 0 days.

(21) Appl. No.: 09/612,659

(22) Filed: Jul. 7, 2000

(30) Foreign Application Priority Data

Jul. 2, 1999 (CA) ..... 2377314

(51) Int. Cl.[7] ..... E05D 11/10
(52) U.S. Cl. ..... 16/334; 16/321; 16/82
(58) Field of Search ..... 16/334, 342, 327, 16/321, 82, 85, 49, 54, 50; 296/146.9, 146.11

(56) References Cited

U.S. PATENT DOCUMENTS 4,829,633 A * 5/1989 Kassner ..... 16/322
5,109,572 A * 5/1992 Park ..... 16/334
5,165,509 A * 11/1992 Kanno et al. ..... 16/342
5,311,644 A * 5/1994 Laforgerie ..... 16/334
5,878,463 A * 3/1999 Kluting et al. ..... 16/334
5,920,960 A * 7/1999 Kluting ..... 16/334

FOREIGN PATENT DOCUMENTS

DE 296 14 386 U1 12/1996

* cited by examiner

*Primary Examiner*—Chuck Y. Mah
(74) *Attorney, Agent, or Firm*—Kramer and Associates P.C.; Gordon J. Zimmerman

(57) ABSTRACT

A door checking apparatus for an automobile comprising an array of needle bearings held in contact with a bearing surface comprising axially oriented grooves, by means of a resilient energy storage device; a cylindrical cage coaxially adjacent the bearing surface and comprising an axially oriented array of slots arranged to retain the needle bearings; means to impart rotary motion to the cylindrical cage to cause the needle bearings to move relative to the bearing surface to create a torque reaction in response to deflection of the resilient energy storage device as the needle bearings move into and out of the grooves; means to transmit the imparted torque from the bearing surface into an appropriate structure.

20 Claims, 2 Drawing Sheets

FIG. 1. A-A
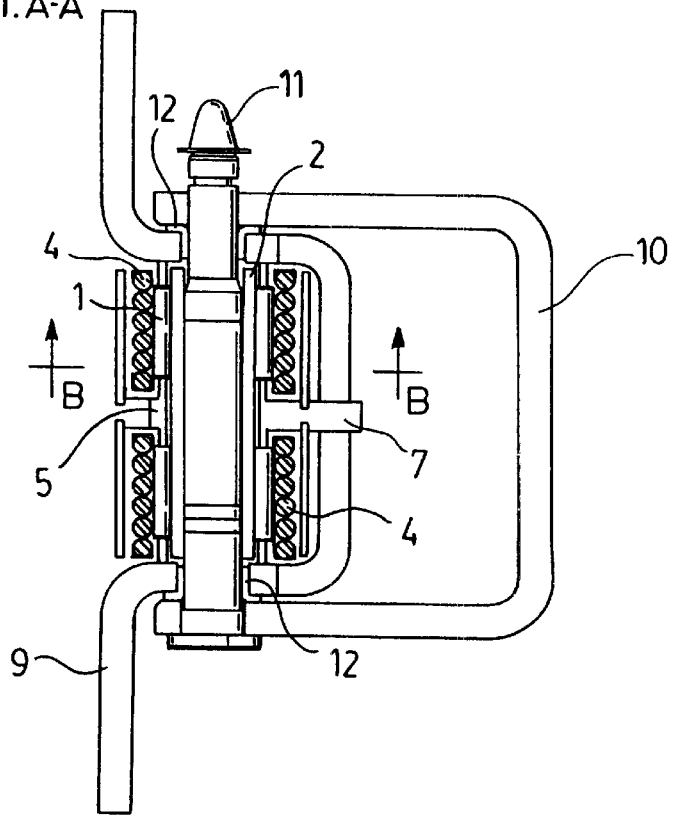
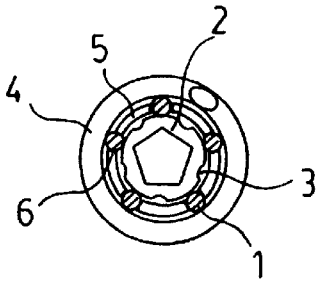
FIG. 2. B-B
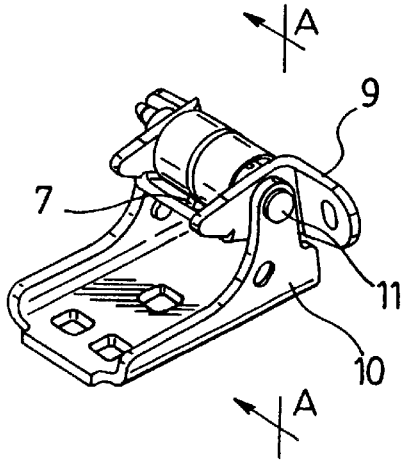
FIG. 3.

FIG.4 A-A
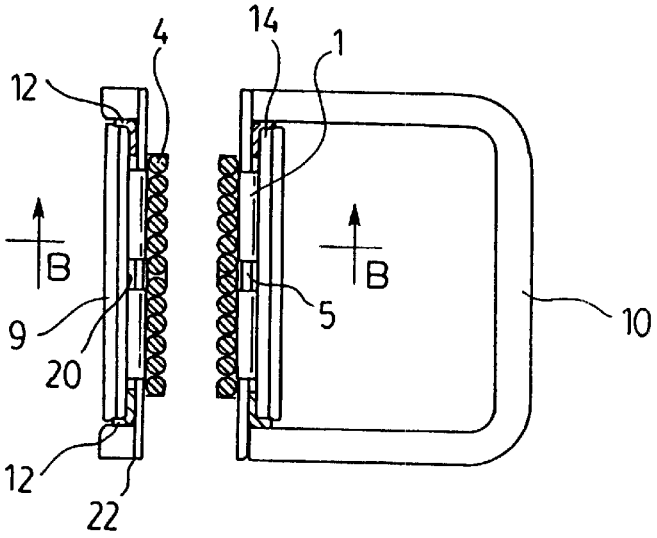
FIG.5 B-B
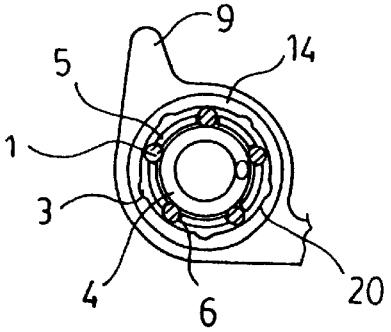
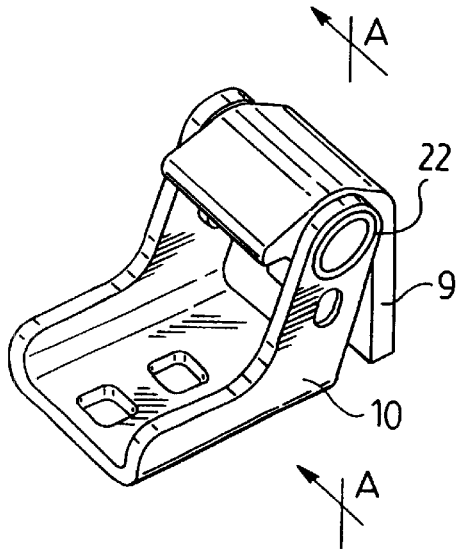
FIG.6.

INTERGRATED DOOR CHECK HINGE FOR AUTOMOBILES

FIELD OF THE INVENTION

This invention relates to automotive door check devices, and in particular to a compact mechanical device capable of holding an automotive door in a number of predetermined open positions with a predetermined force.

DESCRIPTION OF THE PRIOR ART

It has been found useful to check the movement of an automotive door in a number of predetermined open positions to assure convenient and safe ingress/egress of the occupants. The door is normally checked against movement in at least one open position with an effort or resistive force adequate to resist wind gusts and the effect of parking on a grade.

The most common form of automotive door check is a mechanical device that resists motion by releasably storing energy in response to forced motion of the system. These devices, located between the vehicle pillar and door, can be configured to be integral with the door hinge or separate as autonomous mechanical assemblies. Energy storage is generally achieved by using a form of spring with coil and torsion arrangements being the most popular configurations. As the door is opened or closed, the door check device is configured to release energy entering the check positions and to store it when moving out of the check positions. The most common method of storing energy in the spring system is by means of a cam arrangement that moves in conjunction with the door. This cam can work within the hinge to ultimately produce a torque around the pivot axis of the hinge, or can work linearly in a separate checking device which produces a force vector to resist door movement at selected open positions.

Because the door check device must be located between the vehicle pillar and door, it is forced to occupy a severely restricted package space; there is limited clearance between the vehicle pillar and the door. Additionally, the weight of the door check device must not be too great; a significant proportion of the door check system mass resides within the door profile; the door swings on a pivot and is highly sensitive to weight. The size and weight of this device are therefore critical design parameters. The main focus of a door check development is to attain the required check efforts in the smallest possible package at the lowest achievable weight. The type of spring and its related strain energy storage capability combined with the package efficiency of the actuation mechanism dictate the overall effectiveness of the door check system.

GENERAL DESCRIPTION OF THE INVENTION

The present invention is targeted at reducing the weight, cost, complexity and packaging space of an automotive door system checking device. It specifically packages the check effort generating component inside the hinge assembly, coaxial with the hinge pivot axis using a highly space efficient energy storage means. The hinge assembly normally comprises a hinge door component, a hinge body component, and a pivot pin linking these components and allowing them to rotate relative to each other about the pivot pin axis.

Accordingly, in a major aspect, the door checking apparatus for an automobile comprises:

(a) an array of needle bearings held in contact with a bearing surface comprising axially oriented grooves, by means of a resilient energy storage device;

(b) a cylindrical cage coaxially disposed adjacent to the bearing surface and comprising an axially oriented array of slots arranged to retain the needle bearings;

(c) means to impart rotary motion to the cylindrical cage to cause the needle bearings to move relative to the bearing surface to create a torque reaction in response to deflection of the resilient energy storage device as the needle bearings move into and out of the grooves;

(d) means to transmit the imparted torque from the bearing surface into an appropriate structure;

such that when the door checking apparatus is mounted between an automobile door and an automobile body, the rotary movement of the door is checked with predetermined force at positions determined by the relationship between the needle bearings and the grooves.

In further aspects of the invention, the bearing surface comprises the outer surface of a cylindrical shaft or, alternatively, the inside cylindrical bore of a housing member. In a further aspect of the invention, the resilient energy storage device is a coil spring disposed so that energy is stored in response to radial expansion caused by the motion of needle bearings into and out of shaft grooves.

In a further aspect of the invention, the resilient energy storage device is a coil spring disposed so that energy is stored in response to radial compression caused by the motion of the needle bearings into and out of the grooves.

In further aspects of the invention, the profiles of the grooves in the outer surface of the cylindrical shaft, or alternatively, inside the cylindrical bore, are shaped so that the summation of the torque reactions of the needle bearings results in the total required door system check effort.

In a further aspect of the invention, the grooves are arranged circumferentially on the shaft so as to correspond with the door system's check position angles.

In a further aspect of the invention, the grooves are arranged circumferentially inside the cylindrical bore of the housing member so as to correspond with the door system's check position angles.

In a further aspect of the invention, a grooved shaft and cylindrical cage are coaxially disposed with the pivot pin of an automobile door hinge and rotary motion is imparted by the hinge door component and the developed torque is transmitted out of the grooved shaft by the hinge body component.

In a further aspect of the invention, the housing member and cylindrical cage are coaxially disposed with the pivot axis of an automobile door hinge and rotary motion is imparted by the hinge door component via the housing member and the developed torque is transmitted out of the cylindrical cage by the hinge body component.

BRIEF DESCRIPTION OF THE DRAWINGS

FIG. 1 is an elevated cross-sectional view through an integrated door check hinge.

FIG. 2 is a plan, cross-sectional view through a portion of the integrated door check hinge.

FIG. 3 is a perspective view of the integrated door check hinge.

FIG. 4 is an elevated cross-sectional view through an alternative preferred embodiment of the integrated door check hinge.

FIG. 5 is a plan, cross-sectional view through a portion of the alternative preferred embodiment of the integrated door check hinge.

FIG. 6 is a perspective view of the alternative preferred embodiment of the integrated door check hinge.

DETAILED DESCRIPTION OF THE INVENTION

Referring now to the drawings, preferred embodiments of the invention will be described in detail. It will be understood that the invention is not limited to these preferred embodiments, but that they are illustrative of the invention.

Referring to FIGS. 1, 2 and 3, a hollow shaft (2) is coaxially disposed around a door hinge axis pin (11) so as to transmit torque between the shaft and the pin using splines, hexagonal section or similar means. The shaft (2) has an array of axially oriented grooves (3) disposed around its circumference at predetermined angular positions. A cylindrical cage (5) is coaxially disposed around the grooved shaft and contains an array of axially oriented slots (6) retaining a compliment of needle bearings (1). An energy storage device (4), in this case a coil spring, is coaxially disposed over the needle bearings so as to both retain and bias the needle bearings into the grooves (3) located on the outside surface of the shaft (2). The cage (5) includes a torque reaction arm (7) that is coupled to the hinge's door component (9).

The hinge pin is configured so as to transmit torque to the hinge's body component (10) via splines, hexagonal section or similar means. In sectional profile, the grooves (3) are shaped so that as the hinge door component (9) and body component (10) are rotated relative to each other and the needle bearings (1) are forced to climb out of the grooves and expand the energy storage device (4), the summation of the reaction forces creates a total torque magnitude and profile that corresponds to the checking effort requirements of the door system. Additionally, the predetermined angular positions of the grooves (3) correspond with the door system's required check positions. Two bushings (12) are disposed in the hinge door component (9) so as to facilitate ease of rotation of the hinge pin (11) and hinge body component (10) relative to the door component (9).

Referring to FIGS. 4, 5 and 6, an alternative arrangement of the device utilizes a housing member (14) with an internal cylindrical bore (20) that contains an array of axially oriented grooves (3) disposed around its circumference at predetermined angular positions. The housing member (14) is rigidly connected to the hinge's door component (9) via a bolted, riveted or welded joint or similar means. A cylindrical cage (5) is coaxially disposed within the cylindrical bore and contains an array of axially oriented slots (6) retaining a compliment of needle bearings (1). An energy storage device (4) is coaxially disposed within the cylindrical cage (5) and needle bearings (1) so as to both retain and bias the needle bearings into the grooves (3) located on the inside surface of the bore (20). The cage (5) includes a torque reaction device (22) that is coupled to the hinge's body component (10).

In sectional profile, the grooves (3) are shaped so that as the hinge door component (9) and body component (10) are rotated relative to each other and the needle bearings (1) are forced to climb out of the grooves and compress the energy storage device (4), the summation of the reaction forces creates a total torque magnitude and profile that corresponds to the checking effort requirements of the door system. Additionally, the predetermined angular positions of the grooves (3) correspond with the door system's required check positions. Two bushings (12) are disposed in the internal cylindrical bore (20) of the housing member (14) so as to facilitate ease of rotation of the cylindrical cage and hinge body component (10) relative to the door component (9).

A preferred embodiment of the energy storage device (4) is a coil spring wound so as to have no axial space between the coils. A further improvement on the coil spring involves use of square section wire so as to provide either a continuous smooth internal or external bore to act upon the needle bearings (1). Other energy storage devices which could be used include split steel cylinders, rubber/urethane synthetics, and other known devices and materials.

What is claimed is:

1. A door checking apparatus for an automobile comprising:

(a) an array of needle bearings held in contact with a bearing surface comprising grooves that are axially oriented with said needle bearings, by means of a cylindrical and radially resilient energy storage device;

(b) a cylindrical cage coaxially adjacent the bearing surface and comprising an axially oriented array of slots arranged to retain the needle bearings;

(c) means to impart rotary motion to the cylindrical cage to cause the needle bearings to move relative to the bearing surface to create a torque reaction in response to deflection of the resilient energy storage device as the needle bearings move into and out of the grooves;

(d) means to transmit the imparted torque from the bearing surface into an appropriate structure for receiving said torque;

such that when the door checking apparatus is mounted between an automobile door and an automobile body, rotary movement of the door is checked with predetermined force at positions determined by the relationship between the needle bearings and the grooves.

2. A door checking apparatus for an automobile comprising:

(a) an array of needle bearings held in contact with a shaft containing grooves that are axially oriented with said needle bearings, via a resilient energy storage device;

(b) a cylindrical cage coaxially disposed around the grooved shaft and containing an axially oriented array of slots arranged to retain the needle bearings;

(c) means to impart rotary motion to the cylindrical cage causing the needle bearings to move around the grooved shaft creating a torque reaction in response to the deflection of the resilient energy storage device as the needle bearings move into and out of the shaft grooves;

(d) means to transmit the imparted torque out of the grooved shaft and into an appropriate structure for receiving said torque.

3. The door checking apparatus of claim 2, wherein the resilient energy storage device is a coil spring disposed so that energy is stored in response to radial expansion caused by the motion of the needle bearings into and out of the shaft grooves.

4. The door checking apparatus of claim 3, wherein the profile of the grooves in the shaft is shaped so that the summation of the torque reactions of the needle bearings results in the total required door system check effort.

5. The door checking apparatus of claim 3, wherein the grooves are arranged circumferentially on the shaft so as to correspond with the door system's check position angles.

6. The door checking apparatus of claim 3, wherein the coil spring is wound so that there is no space between the coils.

7. The door checking apparatus of claim 2 wherein the profile of the grooves in the shaft is shaped so that the interaction between the groove and needle bearing results in the door being checked.

8. The door checking apparatus of claim 7, wherein the grooves are arranged circumferentially on the shaft so as to correspond with the door system's check position angles.

9. The door checking apparatus of claim 2 wherein the grooves are arranged circumferentially on the shaft so as to correspond with the door system's check position angles.

10. The door checking apparatus of claims 2, 3, 7 or 9, wherein the grooved shaft and cylindrical cage are coaxially disposed with the pivot pin of an automobile door hinge and rotary motion is imparted by the hinge door component and the developed torque is transmitted out of the grooved shaft by the hinge body component.

11. A door checking apparatus for an automobile comprising:

(a) an array of needle bearings held in contact with the inside cylindrical bore of a housing member containing axially oriented grooves, via a cylindrical and radially resilient energy storage device;

(b) a cylindrical cage coaxially disposed within the cylindrical bore of the housing member and containing an axially oriented array of slots arranged to retain the needle bearings;

(c) means to impart rotary motion to the cylindrical cage causing relative motion between the needle bearings and the grooved inner bore creating a torque reaction in response to the deflection of the resilient energy storage device as the needle bearings move into and out of the grooves;

(d) means to transmit the imparted torque out of the cylindrical cage and into an appropriate structure for receiving said torque.

12. The door checking apparatus of claim 11 wherein the resilient energy storage device is a coil spring disposed so that energy is stored in response to radial compression caused by the motion of the needle bearings into and out of the grooves.

13. The door checking apparatus of claim 12, wherein the profile of the grooves inside the cylindrical bore is shaped so that the summation of the torque reactions of the needle bearing results in the total required door system check effort.

14. The door checking apparatus of claim 12, wherein the grooves are arranged circumferentially inside the cylindrical bore so as to correspond with the door system's check position angles.

15. The door checking apparatus of claim 12, wherein the coil spring is wound so that there is no space between the coils.

16. The door checking apparatus of claim 11 wherein the profile of the grooves inside the cylindrical bore is shaped so that the interaction between the grooves and needle bearings results in the door being checked.

17. The door checking apparatus of claim 16, wherein the grooves are arranged circumferentially inside the cylindrical bore so as to correspond with the door system's check position angles.

18. The door checking apparatus of claim 11 wherein the grooves are arranged circumferentially inside the cylindrical bore of the housing members so as to correspond with the door system's check position angles.

19. The door checking apparatus of claims 11, 12, 16 or 18, wherein the housing member and cylindrical cage are coaxially disposed with the pivot axis of an automobile door hinge and rotary motion is imparted by the hinge door component via the housing member and the developed torque is transmitted out of the cylindrical cage by the hinge body component.

20. The door checking apparatus of claims 3 or 12, wherein the coil spring comprises square section wire.

* * * * *

UNITED STATES PATENT AND TRADEMARK OFFICE

CERTIFICATE OF CORRECTION

PATENT NO. : 6,481,056 B1
DATED : November 19, 2002
INVENTOR(S) : Jesse

It is certified that error appears in the above-identified patent and that said Letters Patent is hereby corrected as shown below:

Title page, Item [54] and Column 1, line 1,
Replace the word "INTERGRATED" with the word -- INTEGRATED --.

Title page,
Item [75], the name of the Inventor should read: -- Jesse Gerhart --

Signed and Sealed this

Twenty-ninth Day of April, 2003

JAMES E. ROGAN
*Director of the United States Patent and Trademark Office*